United States Patent [19]

Dziubakowski et al.

[11] 4,435,650

[45] Mar. 6, 1984

[54] LOAD CONTROL FOR ENERGY CONVERTERS

[75] Inventors: Donald J. Dziubakowski, Seven Hills; Azmi Kaya, Akron; Marion A. Keyes, Chagrin Falls; Theodore N. Matsko, Chesterland; William H. Moss, Willoughby; Thomas J. Scheib, Chesterland, all of Ohio

[73] Assignee: The Babcock & Wilcox Company, New Orleans, La.

[21] Appl. No.: 331,060

[22] Filed: Dec. 15, 1981

[51] Int. Cl.[3] ..... H02J 3/00

[52] U.S. Cl. ..... 307/32; 307/57

[58] Field of Search ..... 307/24, 32, 38, 39, 307/40, 52, 57, 58, 82; 290/40 D

[56] References Cited

U.S. PATENT DOCUMENTS 3,076,097 1/1963 Gorrie et al. ..... 307/57
3,229,110 1/1966 Kleinback et al. ..... 307/57
4,136,286 1/1979 O'Halloran et al. ..... 307/57
4,164,661 8/1979 Hucker et al. ..... 307/57

FOREIGN PATENT DOCUMENTS 2071438 9/1981 United Kingdom ..... 307/38

*Primary Examiner*—E. A. Goldberg
*Assistant Examiner*—Todd E. De Boer
*Attorney, Agent, or Firm*—Vytas R. Matas; Robert J. Edwards

[57] ABSTRACT

A load control for a system comprised of a plurality of energy converters wherein a System Control Signal proportional to system load is developed and utilized to simultaneously adjust the rate of energy conversion of each of the converters in parallel in accordance with changes in system load. The rate of energy conversion for each converter, while operating under stead-state conditions for a predetermined period of time, is readjusted until its actual incremental cost of production is equal to a desired incremental cost.

3 Claims, 1 Drawing Figure

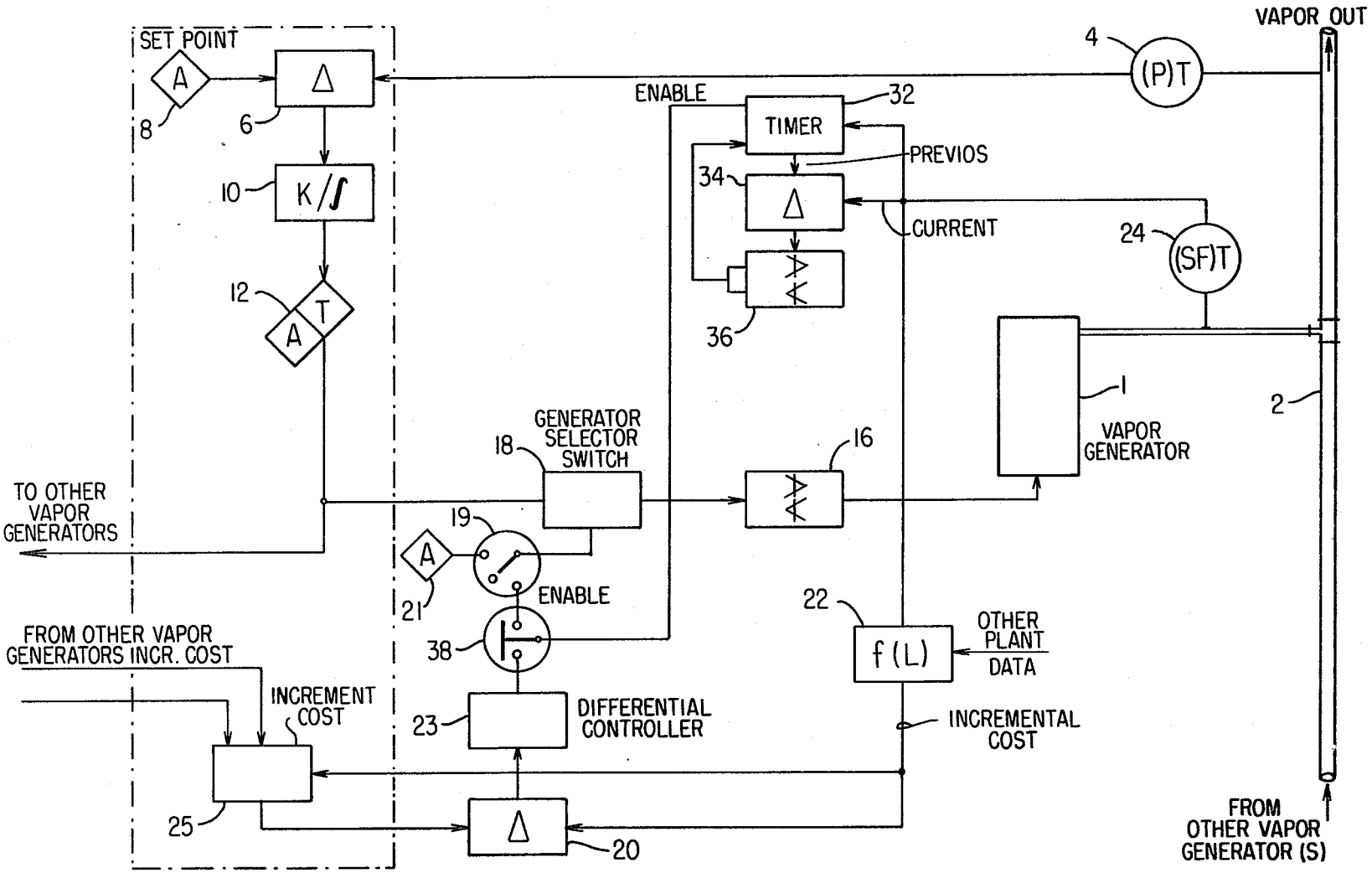
VAPOR OUT
2
FROM OTHER VAPOR GENERATOR (S)
(P)T
4
(SF)T
24
VAPOR GENERATOR
1
OTHER PLANT DATA
INCREMENTAL COST
f (L)
22
PREVIOS
CURRENT
32
TIMER
34
36
16
ENABLE
GENERATOR SELECTOR SWITCH
18
ENABLE
19
21
38
DIFFERENTIAL CONTROLLER
23
20
SET POINT
8
6
K/∫
10
T
12
INCREMENT COST
25
TO OTHER VAPOR GENERATORS
FROM OTHER VAPOR GENERATORS INCR. COST

LOAD CONTROL FOR ENERGY CONVERTERS

TECHNICAL FIELD

This invention relates to the automatic load control of a system comprised of a plurality of energy converters, such as, but not limited to, vapor generators, turbines, blowers, chillers, fans, pumps, compressors, heat exchangers. More particularly the invention related to a load control which distributes the system load among the converters in the system so that the energy conversion is produced at least cost.

BACKGROUND ART

The load control herein described has two main objectives. First, to maintain the energy output of the converters equal to demand and, second, to produce the energy conversion at least at cost. The first objective is obtained by establishing an error signal proportional to the difference between actual and required energy output and from this error signal generating a System Control Signal which operates to adjust all converters in parallel to maintain the total rate of energy output from the system equal to demand.

In accordance with accepted theory the rate of energy conversion required to satisfy a given demand is produced most efficiently when all converters in the system are converting energy at the same incremental cost. We achieve this, our second objective, by generating a System Incremental Cost Signal indicative of the incremental cost at which all converters in the system should operate and readjusting, under steady-state conditions, the rate of energy conversion of each unit until it is operating at this assigned incremental cost.

A primary objective of our invention is therefore to provide a load control wherein, generally, each of the energy converters immediately share in system load changes in proportion to its capability, but wherein the system load among the units is then readjusted, under steady-state conditions, so that each converter operates at the same incremental cost.

A further objective of this invention is to provide a load control of maximum flexibility wherein the components may be easily arranged or rearranged in accordance with the characteristics of the particular system to which it is applied.

These and other objectives will be apparent from the description to follow and from the drawing in which:

IN THE DRAWING

The drawing is a logic diagram of a load control, embodying the principles of this invention, as applied to a system comprised of a plurality of vapor generators.

DETAILED DESCRIPTION

In the drawing and in the following description conventional logic symbols have been used and described. It will be recognized that the components, or hardware as it is sometimes called, which such symbols represent, are commercially available and their operation well understood by those familiar with the art. Further, conventional logic symbols have been used to avoid identification of this invention with any particular type of components such as analog or digital, as this invention comprehends either one, or a combination of such types.

In accordance with their generally accepted practice, vapor generation is maintained equal to demand by utilizing deviations in vapor pressure in the header 2 from a point as an index of unbalance, generating from such deviations a System Control Signal which adjusts the rate of vapor generation in each of the generators, one of which is shown at 1, in parallel to restore equality between vapor generation and vapor demand. Thus there is shown in the drawing a pressure transducer 4, generating a signal transmitted to a difference unit 6 where it is compared to a set-point signal, proportional to the desired vapor pressure, generated in a signal generator 8 and producing an output signal proportional to the difference or error between desired and actual vapor pressures. The output signal from difference unit 6 inputs to a proportional plus integral unit 10 generating a System Control Signal varying as required to maintain system vapor production equal to vapor demand. A System Selector Switch 12 is provided for transfer of the control of the vapor generators to a manually adjustable System Control Signal.

To provide the immediate response, the System Control Signal is transmitted directly through a Generator Selector Switch 18, a high-low limiter 16 to the combustion control (not shown) for the vapor generator 1. The high-low limiter 16 serves to prevent the firing rate going above or below predetermined limits. The Generator Selector Switch 18 provides for transfer of the firing controls from the System Control Signal to a manually adjustable signal.

There may also be introduced into the Selector Switch 18 a bias signal which serves to modify the System Control Signal and hence increase or decrease the firing rate of the generator 1. The bias signal is transmitted to the Selector Switch 18 through a three-position switch 19 so that a manually adjustable bias signal, generated in a Signal Generator 21 may be transmitted to the Selector Switch 18, null bias signal transmitted thereto, or a signal generated in a differential controller 23 transmitted thereto.

To provide for the simultaneous readjustment, during steady-state conditions, of the firing rate of each generator to make the incremental cost of vapor generation of all generators the same, for each generator a signal corresponding to the incremental cost of vapor generation is generated in a function generator 22 responsive to a signal generated in a rate of steam flow transducer 24. To provide the changes in relative fuel cost, generator efficiencies and the like, there may be introduced into the function generator a signal, defined as "other plant data", corresponding to the magnitude of such changes for modification of the output signal from the function generator. The incremental cost signal for each generator in the system is transmitted to a signal generator 25 generating a System Incremental Cost Signal corresponding to the incremental cost at which all generators should operate. The output signal from each function generator 22 is also transmitted to a difference unit 20 which produces an output signal, transmitted to differential controller 23 corresponding to the difference between the System Incremental Cost Signal and the signal from the particular function generator 22.

It is recognized that the readjustment of each generator load to bring its incremental cost to the assigned value should be done only under steady-state conditions, when, for a predetermined period of time, the rate of vapor generation from the generator remains substantially constant. To assure that the readjustment is only made under such steady-state conditions, there is shown a timer 32 into which is introduced, at the start of the timing period, the output signal from steam flow transducer 24, which is transmitted to a difference unit 34, and which remains constant throughout the time period. The constant output signal from timer 32 is subtracted from the current output signal from steam flow transducer 24 in the difference unit 34. So long as the output signal from difference unit 34 remains within limits established in a high-low limiter 36, the output signal of difference unit 34 activates an enable switch 38 allowing the readjustment to proceed. If, however, the output signal from difference unit 34 is greater or less than that established by the high-low limiter 36, switch 38 opens thereby deactivating the readjustment and simultaneously sending a reset signal to timer 32 to initiate a new timing period.

The output signal from differential controller 23, when enable switch 38 is closed and operator bias switch 19 is turned to the "Load Reallocator" position biases the output signal from Generator Selector Switch 18 to readjust the firing rate of generator 1 until its incremental cost of vapor generation is equal to the assigned or system incremental cost. As evident, such readjustment of the firing rate is inhibited when either the enable switch 38 is opened, or by operator action in turning the switch 19 to the manually adjustable bias signal position or to null bias signal position.

While in the interest of brevity and avoidance of repetition, the control has been illustrated and described as applied to only one of the plurality of vapor generators making up a system, it is evident, as indicated on the drawing, that the System Control Signal would be transmitted in like fashion to all other vapor generators and the individual incremental cost signals would be transmitted to the System Incremental Cost Signal generator.

We claim:

1. A load control for a system comprised of a plurality of energy converters, comprising, means generating a system control signal corresponding to the system load for adjusting in parallel the energy output of each of said converters in accordance with changes in the system control signal, means producing an individual incremental cost signal for each of said plurality of converters, means responsive to all of said incremental cost signals generating a system incremental cost signal, means generating a third signal for each of said generators corresponding to the difference between the system incremental cost signal and the individual incremental cost signal for each generator, means under the control of the third signal biasing the energy output of each converter as required to maintain a predetermined relationship between the system incremental cost signal and the individual incremental cost signal and means inhibiting said third signal from biasing the output of a converter, if during predetermined periods of time, the rate of energy output of said one converter fluctuates beyond predetermined limits.

2. In a load control system as set forth in claim 1 wherein each of said plurality of energy converters is a vapor generator.

3. In a load control as set forth in claim 1 wherein said converter is a vapor generator.

* * * * *